US006080921A

United States Patent [19]

Cunningham

[11] Patent Number: 6,080,921

[45] Date of Patent: Jun. 27, 2000

[54] BLADE SHARPING DEVICE FOR A LEVER HARP

[76] Inventor: Robert Cunningham, 446 Clifton Rd., NE., Atlanta, Ga. 30307

[21] Appl. No.: 09/096,809

[22] Filed: Jun. 12, 1998

[51] Int. Cl.[7] ..... G10D 1/04

[52] U.S. Cl. ..... 84/266

[58] Field of Search ..... 84/264, 266

[56] References Cited

U.S. PATENT DOCUMENTS 1,105,879 8/1914 Clark .
3,739,680 6/1973 Christiansen .
4,936,182 6/1990 Bunker .
5,140,883 8/1992 Fay .

*Primary Examiner*—Jeffrey Donels

[57] ABSTRACT

A sharping device for shortening the length of a vibrating string on a lever harp is described. The device consists of an adjustable, freestanding fret in combination with a plastic, rotating blade sharping lever, which the harp player activates by the push of one finger. When rotated, the lever causes a vibrating string to be stopped against the fret. Both lever and fret are located along the neck of a harp so as to raise the frequency of a vibrating string by one semitone.

21 Claims, 5 Drawing Sheets

BLADE SHARPING DEVICE FOR A LEVER HARP

FIELD OF THE INVENTION

This invention relates to an improved sharping device for use on Celtic and other lever harps and more particularly to a blade-type device, that is mounted on the surface of a harp neck and that is rotatable in the plane of that surface.

BACKGROUND OF THE INVENTION

A harp is a stringed musical instrument that enjoys a great deal of popularity today. The harp has a string bank which rises from a soundbox up to the neck of a wooden frame. Each string is secured to the soundbox by a knot tied in the string beneath the soundboard part of the soundbox and is secured above to the frame by a metal tuning pin set perpendicularly into the neck of the frame. The length of the string that vibrates when plucked by an instrument player is termed the vibrating length of the string. The vibrating length of a string is the distance from the string's attachment point to the soundboard up to a table pin. The string is attached to the table pin by winding the string into a groove that is cut around the table pin near the end of the table pin. The distance from the surface of the neck to this groove defines the clearance of the string from the side of the neck.

One type of device used to tune a harp is a sharping lever. A harp which uses a sharping lever is generally termed a lever harp. The lever harp is a small, lightweight, portable harp and is much less costly than the larger, more robust, pedal harp. In a lever harp, tuning is diatonic and chromatic notes are obtained by sharping levers. Sharping levers are small hand-operated devices, one for each string, that are fixed on the side of the neck just below the table pins. Each sharping lever has a rotating handle with a cam portion that displaces the string outwardly from the neck when rotated. This displacement causes a string to vibrate exactly one semitone sharper when the cam engages a string. The lever can act horizontally with respect to the side of the neck (the so-called "blade" lever) or vertically with respect to the side of the neck (the so-called "flip-up" lever). From a structural standpoint, the light construction of a lever harp is not very suited for the tortional pull of the strings on the side of the harp's neck. The amount of torque varies according to the amount of clearance between the string bank and neck, especially when the clearance is increased by operation of the cam: the greater the distance of clearance, the greater the torque, hence the greater the pull against the side of the harp. As the torque increases so does the tendency of the wooden frame of the harp to warp.

There are several types of sharping levers presently available. One very basic kind is the blade lever (FIG. 1*b*), which has a metal rod whose end is friction fitted into a hole drilled into the neck just below the table pin. Its exposed end is flanged to form a cam that is aligned with the string when disengaged or perpendicular to a string when engaged. A drawback to the blade lever is the large sideways string displacement it causes. Additionally, because the cam of the blade lever does not have a mechanism to limit or stop its movement, the player must "feel" for its correct positioning on a string. Also, the player must pinch and turn the cam which is a disturbance to hand position during play. Furthermore, this position is cramped since the levers are closely spaced on some areas of the harp neck. Still another disadvantage of the blade lever is the wear on the fragile material of the string by the metal cam. The chief advantage of the blade lever is that it does not dictate the distance of clearance between string and neck since the cam rises perpendicularly from the neck. A tuning device for a harp should not require a large distance of clearance between the string and neck. A sharping lever should allow a string to lie as close as possible to the surface of the neck.

Another kind of sharping lever is the flip-up lever (FIGS. 2*a* and 2*b*). This kind of lever consists of a bracket securely mounted to the neck just below the table pin. Attached to the bracket is a rotatable cam that acts as fret. A handle extension of the cam is pushed or "flipped" upward in the direction of the string by a player's finger to engage the string and fret, or pulled downward to disengage. Advantages to the flip-up lever include its adjustability and ease of use. A disadvantage of the flip-up lever is the great distance of clearance required between string and neck to house the bracket and mechanism. Other disadvantages include string wear, and the manner in which a string is displaced when engaged, viz., out of plane of the string bank.

A specific model of flip-up sharping lever (FIGS. 2*a* and 2*b*) is made by Robinson's Harp Shop of Mt. Laguna, Calif. This lever consists of a slotted mounting bracket to which is riveted a rotating handle that includes a brass dowel with a turned groove to accept the string. When the handle is pushed up, the dowel is brought up from under the string, displacing the latter above the stringbank. Since the dowel, which serves as a fret for the string, is directed transverse to the string, i.e., in the same direction as the string's oscillation, the displacement of the string must be far upward in order to gain firm pressure between string and groove. Furthermore, the transverse dowel causes slightly different tone quality than the upright table pin. Another disadvantage is that the groove wears a path on the string, reducing the useful life of the string.

Another model of a flip-up sharping lever (FIG. 2*c*) is produced by Loveland Harps of Loveland, Colo. The dowel portion of this lever is fixed to the mounting bracket. A rotating handle lowers a grooved cam down against a string immediately behind the dowel, pressing the string firmly against the dowel. The major drawback of this sharping lever is the large distance of clearance required between string and neck in order for the open string to clear the dowel, fastener, and bracket. Furthermore, the open string must lie at a precise level between the cam and dowel in order not to collide with either. If any change affects this level, such as warpage of the frame or relocation of the lever for purposes of adjustment, then the level of the string must be readjusted at the table pin. In addition to the above models, several other flip-up sharping levers of different make also require much larger distance of clearance between string and neck than the blade sharping lever described earlier, plus one or more of the other drawbacks discussed.

Filament-wrapped strings, sometimes called "bass wires", present a particular difficulty for all types of sharping levers: friction between the wrap and the cam is far greater than for monofilament strings. Rotation of the sharping lever is resisted as the working edge of the cam scrapes along the filament-wrapped string surface. This scraping can cause excessive wear of the filament-wrapped strings.

An object of the present invention is therefore to provide a sharping lever that solves many of the problems of sharping levers. Thus, there is a need in the art for a sharping lever that: (1) is easy to operate on all strings including bass wires; (2) is easy to adjust; (3) has a small clearance distance; (4) has minimal string displacement and wear; (5) has superiority of tone; and (6) has a relatively low cost.

SUMMARY OF THE INVENTION

Generally described, the present invention is a sharping lever for sharping the strings of a lever harp in a manner that minimizes the clearance distance between the strings and harp neck. The lever operates by means of a cam that shortens the vibrating length of the string. The lever is securely attached to the harp neck just below the table pin and adjacent to the harp string. Upward pressure of the harp player's finger on an inwardly curved handle portion of the lever causes the cam portion of the lever to rotate and engage the string, pushing the string to the side. Securely mounted to the harp neck, and independent of the mounting of the lever to the harp, is an adjustable fret located below the lever and on the opposite side of the string. Action of the cam causes the string to bear against this fret thereby sharping the string. Sideways displacement of the string is limited by the fret. The system of the present invention may also include stop pins mounted to the harp to aid in positioning the sharping lever in an optimum preset position for sharping the strings. An advantage of the present invention is its flexibility to minimize the working height of a string above the surface of a neck. By using a sharping lever constructed and installed according to the principles of the present invention, a string is allowed to lie close to the surface, reducing torque on the harp frame.

DETAILED DESCRIPTION OF THE INVENTION

Figure 1A:
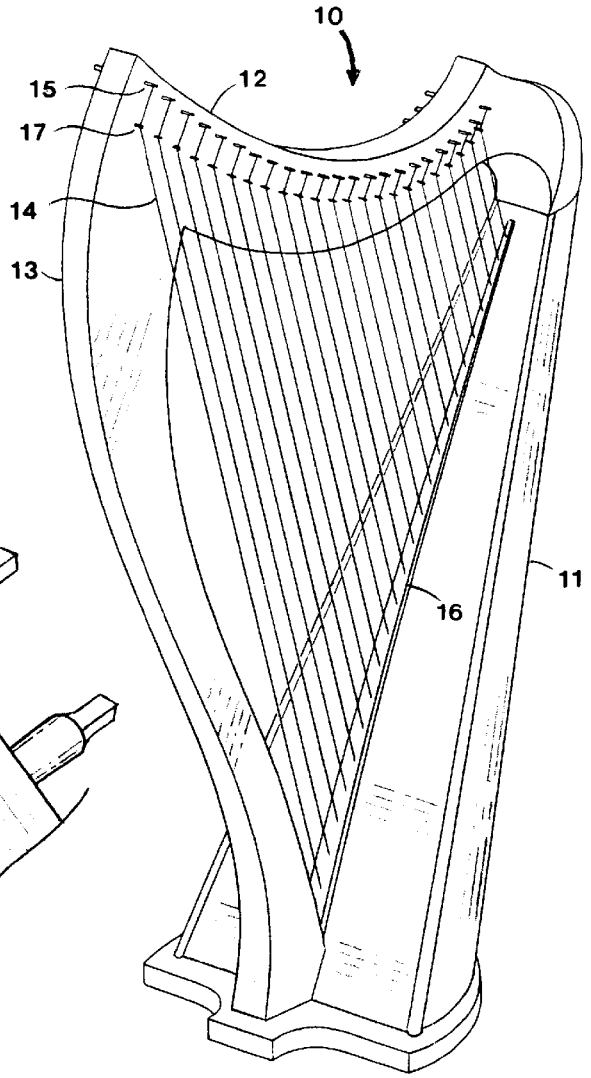
Figure 1B:
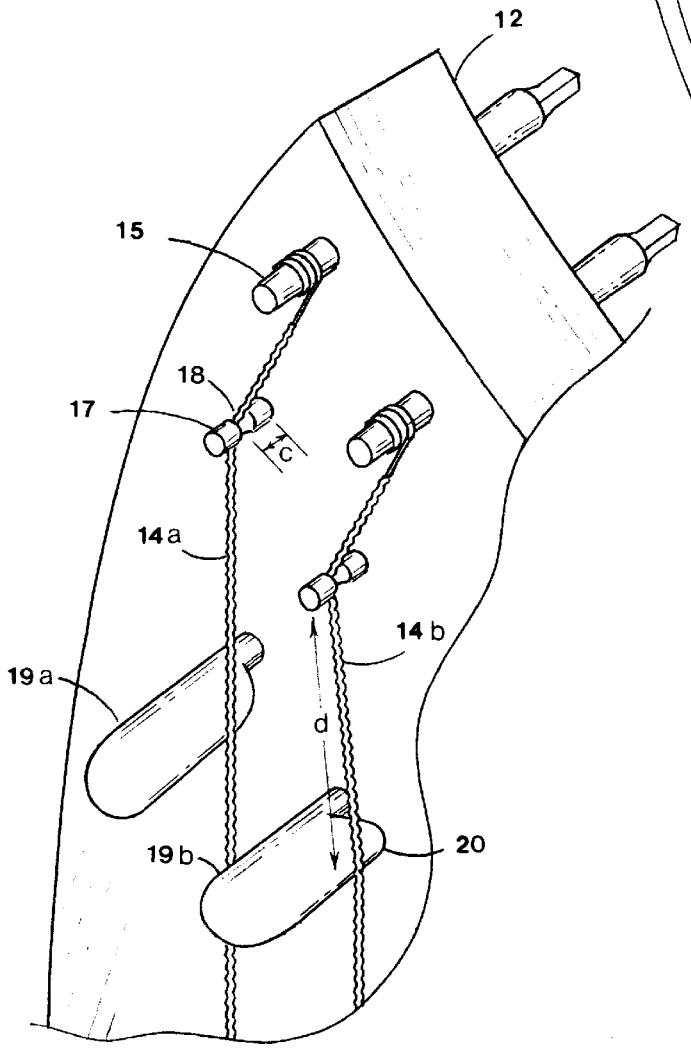
FIG. 1B (PRIOR ART)

Referring to FIGS. 1*a* and 1*b*, a harp 10 is shown. The harp has a soundbox 11, a neck 12, a forecolumn 13 and strings 14. Strings 14 are secured at their upper end by attachment to a tuning pin 15 in a manner generally known in the art. Each string is secured at its lower end by a knot behind a hole drilled through the soundbox rail 16. The vibrating length of a given string is determined by the distance between its attachment point on the rail 16 and the table pin 17. As shown in FIG. 1, table pin 17 has a groove 18 cut around it near the tip of the pin 17 and the string 14 is held into the grove by the string's tension. The distance of the groove 18 from the surface of the neck 12 determines the clearance distance cd of the string 14 above the neck. FIG. 1*b*illustrates a prior art blade sharping lever 19*a*. The lower end of lever 19*a* is a circular shaft that is press-fitted into a hole drilled into neck 12. If a lever 19*b* has been rotated so that its cam 20 is perpendicular to string 21, the vibrating length of string 21 is reduced by distance d so the tone of the plucked string is sharped.

Figure 2A:
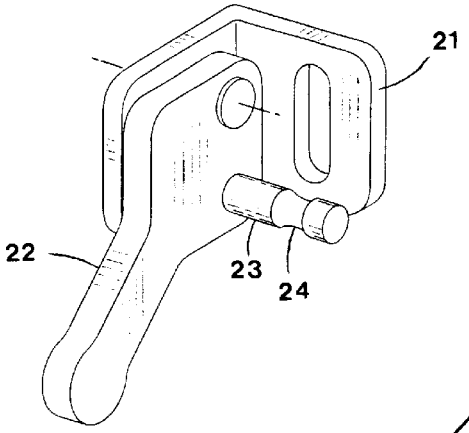
FIG. 2A (PRIOR ART)
Figure 2B:
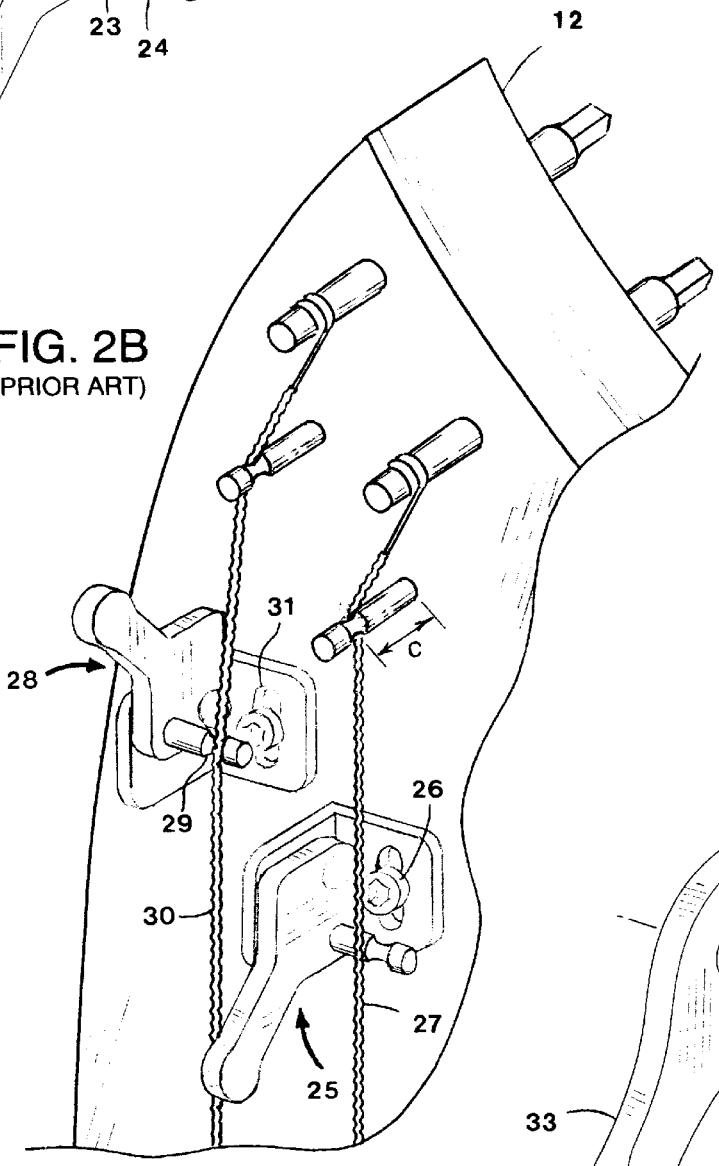
FIG. 2B (PRIOR ART)
Figure 2C:
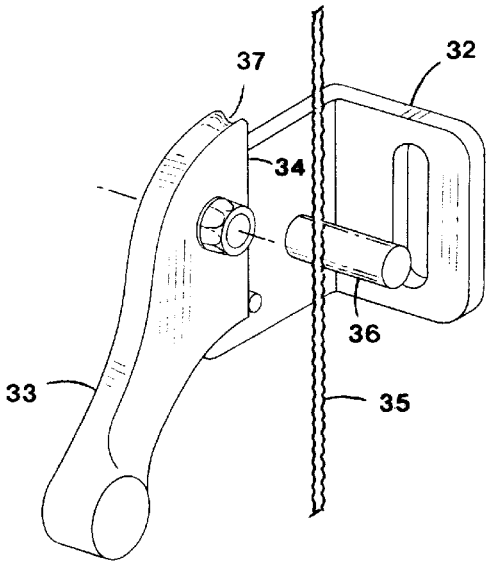
FIG. 2C (PRIOR ART)

Referring to FIGS. 2*a–c*, examples of prior art sharping levers are shown. FIG. 2*a* shows a flip-up sharping lever 23*a* made by Robinson's Harp Shop of Mt. Laguna, Calif. The lever consists of a mounting bracket 24 to which is riveted a handle 25 into which is press-fitted a brass dowel 26 with turned groove 27 to accept the string. FIG. 2*b* illustrates the levers 23*a* and 23*b* installed onto the harp neck 12. The levers 23 are attached to the harp neck by fastener 28. Lever 23*a* is shown in its "down" position with string 14 positioned in front of the dowel of lever 23*a*. Another lever 23*b* is shown rotated up to its "up" position whereby the groove 27 of the dowel and string 30 are engaged. Lever 23*b* shortens the vibrating length of string 30 by a distance that can be adjusted by means of slot 31 cut into the mounting bracket. There are several drawbacks associated with such a sharping lever. The distance of clearance cd1 between string and neck must be great in order to accommodate the sharping lever, and the lever acts to raise the string out of the plane of the string bank. Another drawback is the wear caused by the metal dowel on the string as the groove of the dowel drags along its contact path with the string.

FIG. 2*c* shows another prior art sharping lever 32 made by Loveland Harps of Loveland, Colo. The sharping lever 32 consists of a mounting bracket 33 bearing a rotating handle 34 and grooved cam 35 made of a high lubricity plastic. The sharping lever 32 is illustrated in the "down" position whereby string 36 is between fret pin 37, which is connected to the bracket 33, and cam 35. In the "up" position, the string 36 is received by the groove of 35 and lowered out of plane of the string bank onto fret 37. The design of this sharping lever requires large clearance distance between string and neck to allow space for the mechanism and attachments. Furthermore, the exact amount of clearance is critical and must occasionally be readjusted, as discussed in background of the invention.

Referring now to FIGS. 3*a* and 3*b*, an embodiment of the sharping lever of the present invention is shown. Sharping lever 38 is preferably molded of a high lubricity plastic, such as Delrin P100. The high lubricity material helps to ensure smooth rotation of the sharping lever around the pivot shaft of the lever. Sharping lever 38 includes a cam 39 integrally molded with a handle 40. The handle 40 has an elongated portion with an edge that protrudes a distance hd from the cam portion 39. The cam portion 39 acts as the blade which comes in contact with a string to sharp the string. By providing an integrally molded cam portion 39 with a handle 40 that protrudes a distance hd from the cam portion, the distance which the cam portion 39 or blade displaces the string is not dependent on the handle portion which an instrument player uses to adjust the lever to sharp the strings. Therefore, the distance which the cam displaces the string can be minimized while providing ample handle area for the player to operate the sharping lever 38.

Sharping lever 38 is rotatably attached to the harp neck by means of a bolt or fastener 41 through a hole or a pivot shaft 42. The rear portion 80 of the handle 40 is inset a distance from the pivot shaft 42 to enable the screw or fastener 41 to be placed in the pivot shaft 42 to secure the lever 38 to the harp. The pivot shaft of the lever is sandwiched on the bolt between two TEFLON washers 43. Pivot shaft 42 is precision-molded to fit fastener 41 so that lever 38 may turn freely but without slack. Slight tightening of fastener 41 into the wooden harp neck into which it is screwed causes lever 38 to be compressed between the Teflon washers 43 so that resistance to rotation of the lever can be adjusted.

Figure 4A:
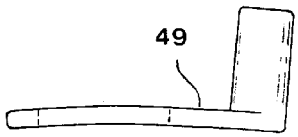
Figure 4B:
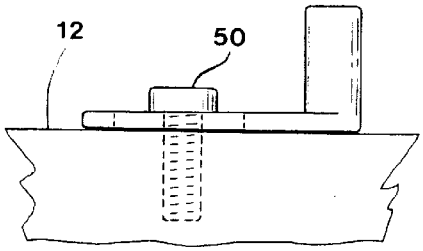

Referring to FIGS. 4*a* and 4*b*, another embodiment of a sharping lever made according to the principles of the present invention is shown. The sharping lever 44 is particularly useful with wrapped bass wire. This lever 44 is similar in design to the lever 38; however, the cam 45 of the lever 44 comprises a roller. Additionally, the pivot shaft 110 structure is not integrally molded with cam 45. The concave surface 120 of the pivot shaft provides clearance for the cam 45. When cam 45 contacts a bass wire string, the cam 45 rotates in the concave surface and along the string. The roller 45 rotates around the axis of the fastener 46. By using a roller as the cam, the string can be sharped while reducing the friction or wear to the string as compared to other sharping levers. FIG. 4*b* shows an exploded view of lever 44. Roller cam 45 is precision-molded of a hard plastic material to fit metal fastener 46. The metal fastener 46 secures roller cam 45 to lever 44 by screwing into hole 47. The hole 47 is molded into the underside of the handle portion of lever 44.

FIG. 5*a* shows an adjustable fret 48 that has a cast metal dowel 49 and curved mounting bracket 50. The mounting bracket is slotted to accept metal fastener 51. FIG. 5*b* illustrates a side view of the adjustable fret secured to neck 52 by the fastener 51. FIG. 5*c* shows a side view of the adjustable fret 48 without attachment. The purpose of the cast curvature of bracket 50 is to better secure the bracket 50 onto neck 52 when flexed down onto the surface of the neck by the fastener. Hence, dowel 49 remains stable under pressure from a string.

Figure 6:
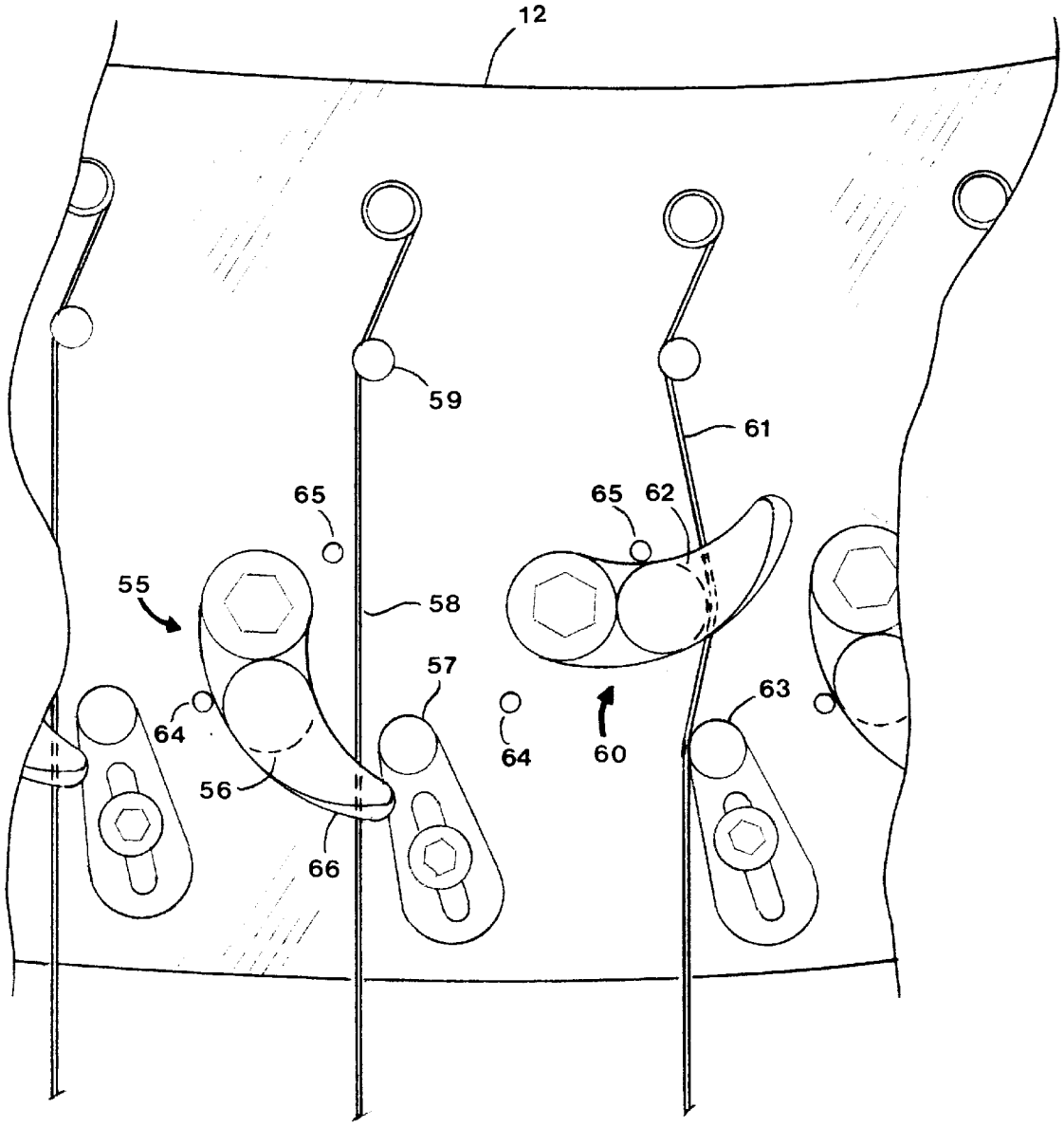

FIG. 6 illustrates the sharping levers and frets installed on the harp neck 53. The view is perpendicular to the side of the neck 53. Lever 54*a* is shown in the "down" position whereby cam 39*a* and dowel 49*a* are clear of string 57 (i.e., not in contact with the string). When string 57 is plucked, it vibrates in its full length, i.e., from table pin 58 to its soundboard attachment. Lever 54*b* is shown in the "up" position whereby string 60 is diverted (sharped) by the cam 39*b* and dowel 49*b*. When the lever is in the up position, the string 60 contacts the cam 39*b* and dowel 49*b*. The fret 49 is secured to the harp neck on the opposite side of the string from the sharping lever to limit sideways displacement of the string when the sharping lever is rotated into contact with the string. When string 60 is plucked, it vibrates in its shortened length, i.e., from dowel 49*b* to its soundboard attachment. The system of the present invention provides frets 49 that are adjustable independent of the position of the levers 39 on the harp.

In order to control and ensure proper positioning of the lever on the harp in either the up or down positions, lower stop pins 63 and upper stop pins 64 are provided which extend perpendicularly from the harp neck 53. The lower stop pins 63 limit the position of the levers 54 when in the down position and the upper stop pins 64 limit the position of the levers 54 when in the up position. By providing the stop pins 63 and 64, consistent positioning of the levers 54 can be assured with respect to each string thereby aiding the instrument player when playing the instrument. Particularly, when the lever is in the down position, the cam portion of the sharping lever is preferably stopped at a position parallel to the string and the handle portion of the sharping lever is stopped at a position that is inclined toward and over the string (i.e., the string being positioned between the curved end of the handle portion and the neck of the harp) as illustrated. The position of the upper stop pins 64 assures that a string will be consistently sharped when the lever is in the up position. In the up position, the sharping lever may be stopped in a position perpendicular to the string with the string positioned between the neck and handle portion. The instrument player may push the lever up to its maximum up position (up to stop 64) without the inconsistency or hassle of having to adjust the lever to its desired or optimum position. The stop pins 63 and 64 are small metal pins press fitted into holes drilled into the neck. About ⅛" of a pin's length extends above the surface of the neck to abut the lower edge of the cam of a sharping lever. Two pins are installed at the base of each lever. The lever 54*a* is stopped by stop pin 63 so that cam 39*a* is aligned with the direction of string 57, and handle 65 is inclined slightly toward and over string 57. The position of the stop pin is selected so that the cam of lever 54*b* is stopped by stop pin 64 slightly above the cam's perpendicular point with string 60.

Figure 7A:
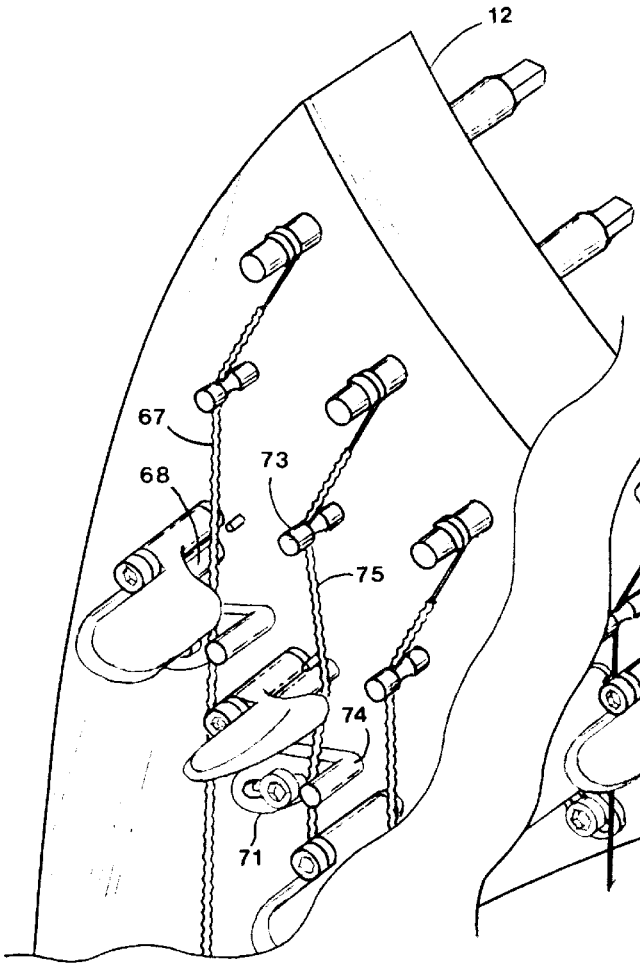
Figure 7B:
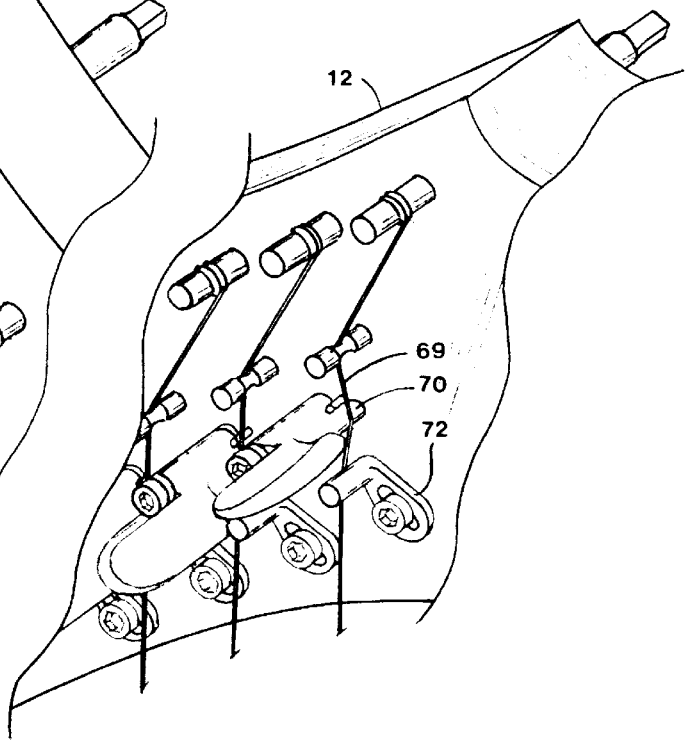

FIGS. 7*a* and 7*b* show perspective views of the blade sharping levers for bass and treble ranges, respectively, on harp neck 12. For filament-wrapped bass wires such as string 66, sharping levers with roller cams 67, such as discussed in connection with FIGS. 4*a* and 4*b*, are preferred; for monofilament strings, such as 68 of the middle and treble range, sharping levers with fixed cams 69, such as discussed in connection with FIGS. 3*a* and 3*b*, are preferred because they are less costly. FIGS. 7*a* and 7*b* also illustrate different orientations of fret brackets, such as 70 and 71, which is often dictated by the varied geometry along the harp neck.

An important aspect of assuring quality tone is the identical geometry of the table pin and dowel pin. That is, the dowel pin (left most surface) for a particular string should be aligned to be on the same line or plane as the left most surface of table pin. This is most readily seen in FIG. 7*a*. For example, table pin 72 and dowel pin 73 both rise perpendicularly from neck 12; string 74 bears onto each pin to the pin's left side. As was discussed in background of the invention, this similarity of string-pin contact produces identical tone quality for a sharped string such as 74 and for an open string such as 66. Another advantage of the present invention is the use of a plastic cam such as 69 which may slide without wear on a string, unlike metal cams of some prior art sharping levers. The plastic roller cam such as 67 does not wear away the filament wrapping of a bass wire, unlike prior art sharping levers. Another advantage of the present invention is its flexibility with regard to the working height of a string above the surface of a neck. By using a sharping lever constructed and installed according to the principles of the present invention, a string is allowed to lie close to the surface, reducing torque on the harp frame.

Although the present invention has been described in detail, those skilled in the art will appreciate that various modifications may be made to the invention defined herein without departing from the scope of the invention.

What is claimed is:

1. An apparatus for shortening the vibrating length of a harp string, comprising:

a sharping lever, said sharping lever having a pivot shaft, a cam, and a handle;

said pivot shaft having an opening through which a fastener is inserted for attachment of said sharping lever to the side of the neck of a harp;

said cam attached to said shaft, said cam having a string contact edge that contacts said string when said sharping lever is rotated in the plane of said neck;

said handle attached to said shaft, said handle extending from said shaft, thereby forming an extension portion for use in rotating said sharping lever.

2. The apparatus of claim 1 wherein said sharping lever is molded of a high lubricity material for smooth rotation of said pivot shaft about said fastener.

3. The apparatus of claim 2 wherein said shaft is secured between two lubricity washers which are threaded onto said fastener, a first of which is between a shaft end and the head of said fastener and a second of which is between another shaft end and said neck.

4. The apparatus of claim 3 wherein the friction of rotation of a sharping lever is adjusted by attachment of said fastener into said neck and the resultant pressure between said washers at the end portions of said shaft.

5. The apparatus of claim 1 wherein the said extension portion of the handle curves upward from the plane of said cam and extends a distance from the string contact edge of the cam, said extension portion for use in rotating the cam into contact with said string.

6. The apparatus of claim 1 wherein said shaft, cam, and handle are molded of a high lubricity material for low frictional resistance of said cam along the surface of a string when the cam is rotated into contact with the string.

7. The apparatus of claim 1 wherein said cam comprises a roller that is operable to rotate when said cam is rotated into contact with the string.

8. The apparatus of claim 7 wherein said roller is secured to said sharping lever by a fastener extending through the roller and into said handle.

9. An apparatus for shortening the vibrating length of a harp string, comprising:

a sharpening lever attached to the neck of a harp and being rotatable in the plane of the neck of the harp to displace a string of said harp; and a first metal pin fixed into the neck of the harp in a position that stops movement of the sharpening lever at a first predetermined position when the sharping lever is rotated into contact with the string.

10. The apparatus of claim 9 wherein said first predetermined position stops a cam portion of said sharping lever at a position perpendicular to said string.

11. The apparatus of claim 9 further comprising a second metal pin fixed into the neck of the harp in a position that stops movement of the sharping lever at the second predetermined position when said sharping lever is not in contact with said string.

12. The apparatus of claim 11 wherein said second metal pin stops said cam portion of said sharping lever at a position parallel to said string.

13. An apparatus for shortening the vibrating length of a harp string, comprising:

a sharping lever attached to the neck of a harp and being rotatable in the plane of the neck of the harp to displace a string of said harp; and a mounting bracket for attachement to said neck, said mounting bracket having a slot through which a fastener is inserted for adjusting attachment of said mounting bracket along said neck; and a dowel that extends outwardly from said mounting bracket and perpendicular to said neck, said dowel having a length sufficient to engage said string when said string is displaced by said sharping lever.

14. The apparatus of claim 13, wherein said mounting bracket is curved along its length and is flexible so as to flatten onto the neck of a harp when secured to said neck by said mounting bracket.

15. The apparatus of claim 13 wherein said dowel is secured to said neck opposite said sharping lever to limit a sideways displacement of said string when said sharping lever is rotated into contact with said string.

16. The apparatus of claim 14 wherein said dowel is secured to said neck opposite said sharping lever to limit a sideways displacement of said string when said sharping lever is rotated into contact with said string.

17. The apparatus of claim 14 further comprising:

a first metal pin fixed into said neck in a position stopping movement of said sharping lever at a first predetermined position when said sharping lever is rotated into contact with said string.

18. The apparatus of claim 17 wherein said first predetermined position stops a cam portion of said sharping lever at a position perpendicular to said string.

19. The apparatus of claim 17 further comprising:

a second metal pin fixed into said neck in a position stopping movement of said sharping lever at a second predetermined position when the sharping lever is not in contact with said string.

20. The apparatus of claim 19 wherein said second metal pin stops said cam portion of said sharping lever at a position parallel to said string.

21. The apparatus of claim 14 wherein said sharping lever has a roller cam for contacting a string of said harp.

* * * * *

UNITED STATES PATENT AND TRADEMARK OFFICE

CERTIFICATE OF CORRECTION

PATENT NO. : 6,080,921
DATED : June 27,2000
INVENTOR(S) : Cunningham

It is certified that error appears in the above-identified patent and that said Letters Patent is hereby corrected as shown below:

Please delete columns 1-8 and substitute columns 1-8 as per attached.

Signed and Sealed this

Twenty-fourth Day of July, 2001

Nicholas P. Godici

*Attest:*

*Attesting Officer*

NICHOLAS P. GODICI
*Acting Director of the United States Patent and Trademark Office*

BLADE SHARPING DEVICE FOR A LEVER HARP

FIELD OF THE INVENTION

This invention relates to an improved sharping device for use on Celtic and other lever harps and more particularly to a blade-type device that is mounted on the surface of a harp neck and that is rotatable in the plane of that surface.

BACKGROUND OF THE INVENTION

A harp is a stringed instrument that enjoys a great deal of popularity today. The harp has a string bank which rises from a soundbox up to the neck of a wooden frame. Each string is secured to the soundbox by a knot tied in the string beneath the soundboard part of the soundbox and is secured above to the frame by a metal tuning pin set perpendicularly into the neck of the frame. The length of the string that vibrates when plucked by an instrument player is termed the vibrating length of the string. The vibrating length of a string is the distance from the string's attachment point to the soundboard up to a table pin. The string is attached to the table pin by winding the string into a groove that is cut around the table pin near the end of the table pin. The distance from the surface of the neck to this groove defines the clearance of the string from the side of the neck.

One type of device used to tune a harp is a sharping lever. A harp which uses a sharping lever is generally termed a lever harp. The lever harp is a small, lightweight, portable harp and is much less costly than the larger, more robust, pedal harp. In a lever harp, tuning is diatonic and chromatic notes are obtained by sharping levers. Sharping levers are small, hand-operated devices, one for each string, that are fixed on the side of the neck just below the table pins. Each sharping lever has a rotating handle with a cam portion that displaces the string outwardly from the neck when rotated. This displacement causes a string to vibrate exactly one semitone sharper when the cam engages a string. The lever can act horizontally with respect to the side of the neck (the so-called "blade" lever) or vertically with respect to the side of the neck (the so-called "flip-up" lever). From a structural standpoint, the light construction of a lever harp is not very suited for the tortional pull of the strings on the side of the harp's neck. The amount of torque varies according to the amount of clearance between the string bank and neck: the greater the distance of clearance, the greater the torque, hence the greater the pull against the side of the neck. As the torque increases so does the tendency of the wooden frame of the harp to warp.

There are several types of sharping levers presently available. One very basic kind is the blade lever (FIG. 1*b*), which has a metal rod whose end is friction-fitted into a hole drilled into the neck just below the table pin. Its exposed end is flanged to form a cam that is aligned with the string when disengaged or perpendicular to a string when engaged. A drawback to the blade lever is the large sideways string displacement it causes. Additionally, because the cam of the blade lever does not have a mechanism to limit or stop its movement, the player must "feel" for its correct positioning on a string. Also, the player must pinch and turn the cam which is a disturbance to hand position during play. Furthermore, this position is cramped since the levers are closely spaced on some areas of the harp neck. Still another disadvantage of the blade lever is the wear on the fragile material of the string by the metal cam. The chief advantage of the blade lever is that it does not dictate the distance of clearance between string and neck since the cam rises perpendicularly from the neck. A tuning device for a harp should not require a large distance of clearance between the string and neck. A sharping lever should allow a string to lie as close as possible to the surface of the neck.

Another kind of sharping lever is the flip-up lever (FIGS. 2*a–c*). This kind of lever consists of a bracket securely mounted to the neck just below the table pin. Attached to the bracket is a rotatable cam that acts as fret. A handle extension of the cam is pushed or "flipped" upward in the direction of the string by a player's finger to engage the string and fret, or pulled downward to disengage. Advantages to the flip-up lever include its adjustability and ease of use. A disadvantage of the flip-up lever is the great distance of clearance required between string and neck to house the bracket and mechanism. Other disadvantages include string wear, and the manner in which a string is displaced when engaged, viz., out of plane of the string bank.

A specific model of flip-up sharping lever (FIGS. 2*a–b*) is made by Robinson's Harp Shop of Mt. Laguna, Calif. This lever consists of a slotted mounting bracket to which is riveted a rotating handle that includes a brass dowel with a turned groove to accept the string. When the handle is pushed up, the dowel is brought up from under the string, displacing the latter above the string bank. Since the dowel, which serves as a fret for the string, is directed transverse to the string, i.e., in the same direction as the string's oscillation, the displacement of the string must be far upward in order to gain firm pressure between string and groove. Furthermore, the transverse dowel causes slightly different tone quality than the upright table pin. Another disadvantage is that the groove wears a path on the string, reducing the useful life of the string.

Another model of flip-up sharping lever (FIG. 2*c*) is produced by Loveland Harps of Loveland, Colo. The dowel portion of this lever is fixed to the mounting bracket. A rotating handle lowers a grooved cam down against a string immediately behind the dowel, pressing the string firmly against the dowel. The major drawback of this sharping lever is the large distance of clearance required between string and neck in order for the open string to clear the dowel, fastener, and bracket. Furthermore, the open string must lie at a precise level between the cam and dowel in order not to collide with either. If any change affects this level, such as warpage of the frame or relocation of the lever for purposes of adjustment, then the level of the string must be readjusted at the table pin. In addition to the above models, several other flip-up sharping levers of different make also require much larger distance of clearance between string and neck than the blade sharping lever described earlier, plus one or more of the other drawbacks discussed.

Filament-wrapped strings, sometimes called "bass wires", present a particular difficulty for all types of sharping levers: friction between the wrap and the cam is far greater than for monofilament strings. Rotation of the sharping lever is resisted as the working edge of the cam scrapes along the filament-wrapped string surface. This scraping can cause excessive wear of the filament-wrapped strings.

An object of the present invention is therefore to provide a sharping lever that solves many of the problems of sharping levers. Thus, there is a need in the art for a sharping lever that: (1) is easy to operate on all strings including bass wires; (2) is easy to adjust; (3) has a small clearance distance; (4) has minimal string displacement and wear; (5) has superiority of tone; and (6) has a relatively low cost.

SUMMARY OF THE INVENTION

Generally described, the present invention is a sharping lever for sharping a string of a lever harp in a manner that minimizes the clearance distance between the string and harp neck. The lever operates by means of a cam that shortens the vibrating length of the string. The lever is securely attached to the harp neck just below the table pin and adjacant to the harp string. Upward pressure of the harp player's finger on an inwardly curved handle portion of the lever causes the cam portion of the lever to rotate and engage the string, pushing the string to the side. Securely mounted to the harp neck, and independent of the mounting of the lever to the neck, is an adjustable fret located below the lever and on the opposite side of the string. Action of the cam causes the string to bear against this fret thereby sharping the string. Sideways displacement of the string is limited by the fret. The system of the present invention may also include stop pins mounted to the neck to aid in positioning the sharping lever in an optimum preset position for sharping the string. An advantage of the present invention is its flexibility to minimize the working height of a string above the surface of a neck. By using a sharping lever constructed and installed according to the principles of the present invention, a string is allowed to lie close to the surface, reducing torque on the harp frame.

DETAILED DESCRIPTION OF THE INVENTION

Referring to FIG. 1*a*, a harp 10 is shown. The harp has a soundbox 11, a neck 12, a forecolumn 13, and strings 14. Strings 14 are secured at their upper ends by attachment to tuning pins 15 in a manner generally known in the art. The strings are secured at their lower ends by knots behind holes drilled through the soundbox rail 16. The vibrating lengths of the strings are determined by the distances between attachment points on the rail 16 and table pins 17. As shown in FIG. 1*b*, table pin 17 has a groove 18 cut around it near its tip, and string 14*a* is held into the groove by the string's tension. The distance of the groove 18 from the surface of the neck 12 determines the clearance distance c of string 14*a* above the neck. FIG. 1*b* illustrates a prior art blade sharping lever 19*a*. The lower end of lever 19*a* is a circular shaft that is press-fitted into a hole drilled into neck 12. If a lever 19*b* has been rotated so that its cam 20 is perpendicular to string 14*b*, the vibrating length of string 14*b* is reduced by distance d so the tone of the plucked string is sharped.

Referring to FIGS. 2*a*–*c*, examples of prior art sharping levers are shown. FIG. 2*a* shows a flip-up sharping lever made by Robinson's Harp Shop of Mt. Laguna, Calif. The lever consists of a mounting bracket 21 to which is riveted a handle 22 into which is press-fitted a brass dowel 23 with turned groove 24 to accept the string. FIG. 2*b* illustrates these sharping levers installed onto the harp neck 12. Lever 25 is attached to the harp neck by fastener 26. Lever 25 is shown in its "down" position with string 27 positioned above and clear of the dowel of lever 25. Another lever 28 is shown rotated to its "up" position whereby the groove 29 of the dowel and string 30 are engaged. Lever 28 shortens the vibrating length of string 30 by a distance that can be adjusted by means of slot 31 cut into the mounting bracket. There are several drawbacks associated with such a sharping lever. The distance of clearance c between string and neck must be great in order to accomodate the sharping lever, and the lever acts to raise the string out of the plane of the string bank. Another drawback is the wear caused by the metal dowel on the string as the groove of the dowel drags along its contact path with the string.

FIG. 2*c* shows another prior art sharping lever made by Loveland Harps of Loveland, Colo. The sharping lever consists of a mounting bracket 32 bearing a rotating handle 33 and grooved cam 34 made of a high lubricity plastic. The sharping lever is illustrated in the "down" position whereby a string 35 is between dowel 36, which is connected to bracket 32, and cam 34. In the "up" position, the string 35 is received by the groove 37 of cam 34 and lowered out of plane of the string bank onto dowel 36. The design of this sharping lever requires large clearance distance between string and neck to allow space for the mechanism and attachments. Furthermore, the exact amount of clearance is critical and must occasionally be readjusted, as discussed in background of the invention.

Figure 3:
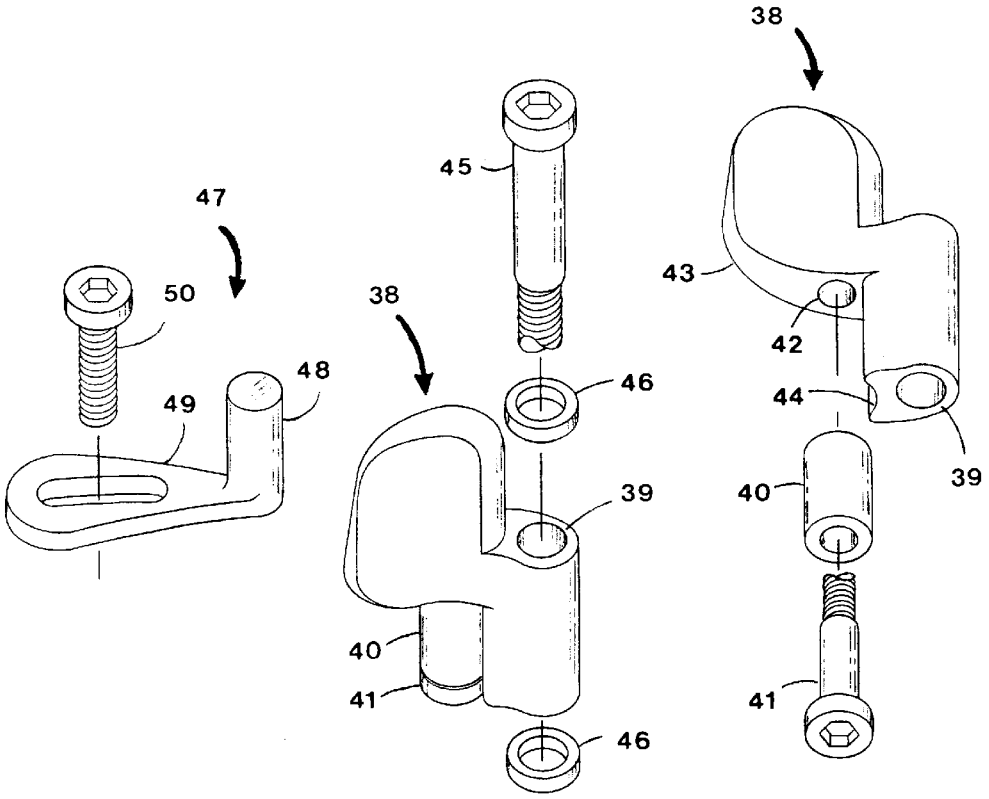

Referring now to FIG. 3, an embodiment of the sharping lever system of the present invention is shown. Sharping lever 38 is preferably molded of a high lubricity plactic, such as Delrin®. The high lubricity material helps to insure smooth rotation of the sharping lever around the pivot shaft 39 of the lever. Sharping lever 38 includes a roller cam 40 that rotates around the axis of fastener 41. Roller cam 40 acts as the blade which comes in contact with a string to sharp the string. Roller cam 40 is precision-molded of a hard plastic material to fit metal fastener 41. The metal fastener 41 secures roller cam 40 to lever 38 by screwing into hole 42. The hole 42 is molded into the underside of the handle portion 43 of lever 38. The concave surface 44 of the pivot shaft 39 provides clearance for the cam 40. By using a roller as the cam, the string can be sharped while reducing friction and wear to the string as compared to other types of sharping levers; for this reason, the roller cam is particularly suited for use with wrapped bass wire. Sharping lever 38 is rotatably attached to the neck of a harp by means of fastener 45 through the pivot shaft 39. The pivot shaft of the lever is sandwiched on the fastener 45 between two Teflon® washers 46. Pivot shaft 39 is precision-molded to fit fastener 45 so that lever 38 may turn freely but without slack. Slight tightening of fastener 45 into the wooden harp neck into which it is screwed causes pivot shaft 39 to be compressed between the washers 46 so that resistance to rotation of the lever 38 can be adjusted.

FIG. 3 also shows an adjustable fret 47 that has a cast metal dowel 48 and curved mounting bracket 49. The dowel portion of fret 47 bears against a harp string when the string has been displaced by action of the sharping lever. The metal mounting bracket of fret 47 is slotted to accept metal fastener 50. The purpose of the cast curvature of bracket 49 is to better secure the bracket when it is flexed down onto the flat surface of the harp neck by fastener 50 which is screwed into the wooden harp neck. Hence, dowel 48 may remain stable when under pressure and vibration of a string. The system of the present invention provides frets that are adjustable independent of the position of the levers on the harp neck.

FIG. 4*a* shows a side view of fret 47 to illustrate the curvature of bracket 49, and FIG. 4*b* illustrates bracket 49 flattened and secured onto harp neck 12 by fastener 50.

Figure 5:
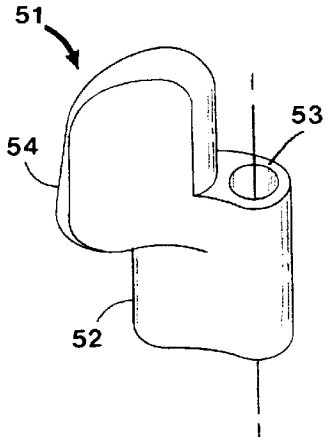

FIG. 5 shows another embodiment of a sharping lever made according to the principles of the present invention. This sharping lever 51 is similar in design to sharping lever 38; however, the cam 52, the pivot shaft 53, and the handle 54 of lever 51 are integrally molded of a material such as Delrin®. The cam portion 52 acts as the blade which comes in contact with a string to sharp the string. Sharping lever 51 is more suitable and less costly than a roller cam sharping lever such as lever 38 for upper range (treble) strings of a harp where string tension is less and string spacing (the distance between the strings) is smaller.

FIG. 6 illustrates the sharping levers and frets installed on the harp neck 12. The view is perpendicular to the side of neck 12. Lever 55 is shown in the "down" position whereby cam 56 and dowel 57 are clear of string 58 (i.e., not in contact with the string). When string 58 is plucked, it vibrates in its full length, i.e., from table pin 59 to its soundboard attachment. Lever 60 is shown in the "up" position whereby string 61 is diverted (sharped) by the cam 62 and dowel 63. When the lever is in the up position, the string 61 contacts the cam 62 and dowel 63. Sideways displacement of string 61 is limited by the position of dowel 63 since the latter is situated oppositely the string 61 from sharping lever 60. When string 61 is plucked, it vibrates in its shortened length, i.e., from dowel 63 to its soundboard attachment.

In order to control and insure proper positioning of the lever on the harp neck in either the up or down positions, lower stop pins 64 and upper stop pins 65 are provided which extend perpendicularly from the harp neck 12. The lower stop pins 64 limit the position of the levers, such as lever 55, when in the down position, and the upper stop pins 65 limit the position of the levers, such as lever 60, when in the up position. By providing the stop pins, consistent positioning of the levers can be assured with respect to each string thereby aiding the instrument player when the player is setting the levers. Particularly, when sharping lever 55 is in the down position, the cam portion 56 of the lever is preferably stopped at a position roughly parallel to the string and the handle portion 66 of the lever is stopped at a position that is inclined toward and over the string, as illustrated. The position of the upper stop pins assures that a string will be consistently sharped when the lever is in the up position. In the up position, the sharping lever may be stopped in a position roughly perpendicular to the string as illustrated by lever 60. The instrument player may push the lever up to its maximum up position (up to stop 65) without the inconsistency or hassle of having to adjust the lever to its desired or optimum position. The stop pins 64 and 65 are small, metal pins press-fitted into holes drilled into the neck. About ½" of a pin's length extends above the surface of the neck to abut the lower edge of the cam of a sharping lever. Two pins are installed at the base of each lever.

FIGS. 7*a–b* show perspective views of the blade sharping levers for bass and treble ranges, respectively, on harp neck 12. For filament-wrapped bass wires such as string 67, a sharping lever with roller cam 68, such as discussed in connection with FIG. 3, is preferred; for monofilament strings, such as 69 of the middle and treble range, a sharping lever with fixed cam 70, such as discussed in connection with FIG. 5, may be preferred. FIGS. 7*a–b* also illustrate different orientations of fret brackets, such as brackets 71 and 72. Due to spacing, different orientations of brackets may be required on different regions of the harp neck.

An important aspect of assuring quality tone is the identical geometry of the table pin and the dowel of the fret. That is, the dowel for a particular string should be aligned just as the table pin is aligned with respect to the string. This is most readily seen in FIG. 7*a*.: table pin 73 and dowel 74 both rise perpendicularly from neck 12; string 75 bears onto the left side of table pin 73 and onto the left side of dowel 74. As was discussed in background of the invention, this similarity of string-pin contact and string-dowel contact produces identical tone quality for a sharped string such as string 75 and for an open string such as string 67. Another advantage of the present invention is the use of a plastic cam such as cam 70 which may slide without wear on a string, unlike metal cams of some prior art sharping levers. The plastic roller cam such as cam 68 does not wear away the filament wrapping of a bass wire, unlike prior art sharping levers.

Another advantage of the present invention is its flexibility with regard to the working height of a string above the surface of a neck. By using a sharping lever constructed and installed according to the principles of the present invention, a string is allowed to lie close to the neck surface, reducing torque on the harp frame.

Although the present invention has been described in detail, those skilled in the art will appreciate that various modifications may be made to the invention defined herein without departing from the scope of the invention.

What is claimed is:

1. An apparatus for shortening the vibrating length of a harp string, comprising:

a sharping lever, said sharping lever having a pivot shaft, a cam, and a handle;

said pivot shaft having an opening through which a fastener is inserted for attachment of said sharping lever to the side of the neck of a harp;

said cam attached to said shaft, said cam having a string contact edge that contacts said string when said sharping lever is rotated in the plane of said neck;

said handle attached to said shaft, said handle extending from said shaft, thereby forming an extension portion for use in rotating said sharping lever.

2. The apparatus of claim 1 wherein said sharping lever is molded of a high lubricity material for smooth rotation of said pivot shaft about said fastener.

3. The apparatus of claim 2 wherein said shaft is secured between two lubricity washers which are threaded onto said fastener, a first of which is between a shaft end and the head of said fastener and a second of which is between another shaft end and said neck.

4. The apparatus of claim 3 wherein the friction of rotation of a sharping lever is adjusted by attachment of said fastener into said neck and the resultant pressure between said washers at the end portions of said shaft.

5. The apparatus of claim 1 wherein the said extension portion of the handle curves upward from the plane of said cam and extends a distance from the string contact edge of the cam, said extension portion for use in rotating the cam into contact with said string.

6. The apparatus of claim 1 wherein said shaft, cam, and handle are molded of a high lubricity material for low frictional resistance of said cam along the surface of a string when the cam is rotated into contact with the string.

7. The apparatus of claim 1 wherein said cam comprises a roller that is operable to rotate when said cam is rotated into contact with the string.

8. The Apparatus of claim 7 wherein said roller is secured to said sharping lever by a fastener extending through the roller and into said handle.

9. An apparatus for shortening the vibrating length of a harp string, comprising:

a sharping lever attached to the neck of a harp and being rotatable in the plane of the neck of the harp to displace a string of said harp; and a first metal pin fixed into the neck of the harp in a position that stops movement of the sharping lever at a first predetermined position when the sharping lever is rotated into contact with the string.

10. The apparatus of claim 9 wherein said first predetermined position stops a cam portion of said sharping lever at a position perpendicular to said string.

11. The apparatus of claim 9 further comprising a second metal pin fixed into the neck of the harp in a position that stops movement of the sharping lever at a second predetermined position when said sharping lever is not in contact with said string.

12. The apparatus of claim 11 wherein said second metal pin stops said cam portion of said sharping lever at a position parallel to said string.

13. An apparatus for shortening the vibrating length of a harp string, comprising:

a sharping lever attached to the neck of a harp and being rotatable in the plane of the neck of the harp to displace a string of said harp; and a mounting bracket for attachment to said neck, said mounting bracket having a slot through which a fastener is inserted for adjusting attachment of said mounting bracket along said neck; and a dowel that extends outwardly from said mounti bracket and perpendicular to said neck, said dow having a length sufficient to engage said string wh said string is displaced by said sharping lever.

14. The apparatus of claim 13 wherein said mounti bracket is curved along its length and is flexible so as flatten onto the neck of a harp when secured to said neck said mounting bracket.

15. The apparatus of claim 13 wherein said dowel secured to said neck opposite said sharping lever to limi sideways displacement of said string when said sharpi lever is rotated into contact with said string.

* * * * *